US007654720B2

(12) United States Patent
Glassner

(10) Patent No.: US 7,654,720 B2
(45) Date of Patent: Feb. 2, 2010

(54) DEDICATED LED AIRFIELD SYSTEM ARCHITECTURES

(75) Inventor: Alan Glenn Glassner, Columbus, OH (US)

(73) Assignee: ADB Airfield Solutions LLC, Columbus, OH (US)

( * ) Notice: Subject to any disclaimer, the term of this patent is extended or adjusted under 35 U.S.C. 154(b) by 400 days.

(21) Appl. No.: 11/382,158

(22) Filed: May 8, 2006

(65) Prior Publication Data

US 2006/0255749 A1 Nov. 16, 2006

Related U.S. Application Data

(60) Provisional application No. 60/679,601, filed on May 10, 2005.

(51) Int. Cl.
*F21V 7/04* (2006.01)
*H05B 37/00* (2006.01)

(52) U.S. Cl. ..... 362/611; 315/200 R

(58) Field of Classification Search ..... 315/50, 315/56, 97, 112, 117–118, 200 R, 246, 224; 362/611, 612, 800
See application file for complete search history.

(56) References Cited

U.S. PATENT DOCUMENTS 4,243,951 A * 1/1981 Wolkstein et al. ..... 372/26
5,962,929 A 10/1999 Brosh et al.
6,191,541 B1 2/2001 Patel et al.
6,362,578 B1 3/2002 Swanson et al.
7,239,087 B2 * 7/2007 Ball ..... 315/128
7,318,661 B2 * 1/2008 Catalano ..... 362/297
2002/0047596 A1 4/2002 Guthrie et al.
2004/0036418 A1 2/2004 Rooke et al.
2004/0150355 A1 8/2004 Tani et al.
2004/0195978 A1 10/2004 Horiuchi et al.
2004/0208011 A1 10/2004 Horiuchi et al.
2005/0007085 A1 * 1/2005 Murakami ..... 323/282
2005/0030192 A1 2/2005 Weaver et al.
2005/0057554 A1 3/2005 Yamamoto et al.
2005/0190078 A1 9/2005 Salter
2006/0006821 A1 * 1/2006 Singer et al. ..... 315/312
2006/0007012 A1 1/2006 Machi et al.
2006/0022122 A1 * 2/2006 Tan et al. ..... 250/226
2006/0033484 A1 * 2/2006 Kung et al. ..... 323/334
2006/0050507 A1 * 3/2006 Morrow et al. ..... 362/227

FOREIGN PATENT DOCUMENTS

EP 1429584 6/2004

OTHER PUBLICATIONS

Ohno, et al., Modified Allard Method for Effective Intensity of Flashing Lights, Apr. 23, 2003, pp. 1-6.
European Search Report for Application No. 06113773.3-1239/1722600 EP dated Mar. 6, 2009.

* cited by examiner

*Primary Examiner*—Douglas W Owens
*Assistant Examiner*—Minh D A

(57) ABSTRACT

A system and method that contemplates operating an LED at its characterized current (e.g. 400 mA) for any luminous intensity. A Pulse Width Modulation (PWM) is employed, wherein the pulse width of the pulse width modulated signal is used to control the luminous intensity of the LED. Optionally, the LED can be biased to reduce the intensity of the pulses used to operate the LED.

17 Claims, 9 Drawing Sheets

1100

DEDICATED LED AIRFIELD SYSTEM ARCHITECTURES

CROSS-REFERENCE TO RELATED APPLICATIONS

This application claims the benefit of priority of U.S. Provisional Application No. 60/679,601, filed on May 10, 2005.

BACKGROUND OF THE INVENTION

The present invention relates generally to Light Emitting Diode "LED" lighting systems and more particularly LED lighting systems suitably adapted for airfield lighting (e.g. runway, taxiway and obstruction lights)

Airport edge lighting has been in existence for many years utilizing incandescent lighting technology. Conventional designs that utilize incandescent lights have higher power requirements, lower efficiency, and low lamp life which needs frequent, costly relamping by maintenance professionals.

Some airfield-lighting manufacturers are using more efficient devices such as LEDs where the LEDs are arranged in multiple rings shining outward. Optics of some sort are then used to concentrate the light in the vertical and horizontal directions to meet Federal Aviation Administration (FAA) specifications.

LEDs are current driven devices. A regulated DC current flows through each LED when the LED is conducting. There are two primary concerns with a pure DC power source. First, a field insulation resistance fault may degrade faster (corona or arc welder effect) and second, dimming.

Dimming is usually accomplished by reducing DC current, however LEDs are not reliable when operating at lower current levels. For example, LEDs available from Philips Lumileds Lighting Company, 370 West Trimble Road, San Jose, Calif., 95131 USA, Phone: (408) 964-2900, are on a die that contains many individual LED structures. If enough current is not provided, the current is not evenly distributed across the die, causing uneven illumination. Operation below 100 mA becomes extremely sporadic, and the LEDs may fail to light at all. Also, luminous flux output between devices is extremely uneven.

BRIEF SUMMARY OF THE INVENTION

The following presents a simplified summary of the invention in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In accordance with an aspect of the present invention, there is disclosed herein a system and method that contemplates operating an LED at its characterized current (e.g. 400 mA, 1600 mA) for any luminous intensity. A Pulse Width Modulation (PWM) is employed, wherein the pulse width of the pulse width modulated signal is used to control the luminous intensity of the LED. Optionally, the LED can be biased to reduce the intensity of the pulses used to operate the LED.

In accordance with an aspect of the present invention, there is disclosed herein an apparatus comprising a light emitting diode and control logic coupled to the light emitting diode. The control logic is configured to operate the light emitting diode with a pulse width modulated signal having an associated pulse width. The control logic achieves a desired level of luminous intensity from the light emitting diode by adjusting the pulse width of the pulse width modulated signal. "Logic", as used herein, includes but is not limited to hardware, firmware, software and/or combinations of each to perform a function(s) or an action(s), and/or to cause a function or action from another component. For example, based on a desired application or need, logic may include a software controlled microprocessor, discrete logic such as an application specific integrated circuit (ASIC), a programmable/programmed logic device, memory device containing instructions, or the like, or combinational logic embodied in hardware. Logic may also be fully embodied as software.

In accordance with an aspect of the present invention, there is disclosed herein an apparatus comprising a light emitting diode and means for operating the light emitting diode coupled to the light emitting diode. The means for operating the light emitting diode is configured to operate the light emitting diode with a pulse width modulated signal having an associated pulse width, achieving a desired level of light intensity from the light emitting diode by adjusting the pulse width of the pulse width modulated signal.

In accordance with an aspect of the present invention, there is described herein a method, comprising applying a pulse width modulated signal having an associated pulse width to a light emitting diode. The pulse width of the pulse width modulated signal is adjusted to achieve a desired luminous intensity from the light emitting diode.

Still other objects of the present invention will become readily apparent to those skilled in this art from the following description wherein there is shown and described a preferred embodiment of this invention, simply by way of illustration of at least one of the best modes best suited to carry out the invention. As it will be realized, the invention is capable of other different embodiments and its several details are capable of modifications in various obvious aspects all without departing from the invention. Accordingly, the drawing and descriptions will be regarded as illustrative in nature and not as restrictive.

BRIEF DESCRIPTION OF THE SEVERAL VIEWS OF THE DRAWING

The accompanying drawings incorporated in and forming a part of the specification, illustrates several aspects of the present invention, and together with the description serve to explain the principles of the invention.

DETAILED DESCRIPTION OF INVENTION

Throughout this description, the preferred embodiment and examples shown should be considered as exemplars, rather than limitations, of the present invention. In accordance with an aspect of the present invention, there is disclosed herein a system and method that contemplates operating an LED at its characterized current (e.g. 400 mA, 1600 mA) for any luminous intensity. A Pulse Width Modulation (PWM) is employed, wherein the pulse width of the pulse width modulated signal is used to control the luminous intensity of the LED. Optionally, the LED can be biased to reduce the intensity of the pulses used to operate the LED.

Figure 1:
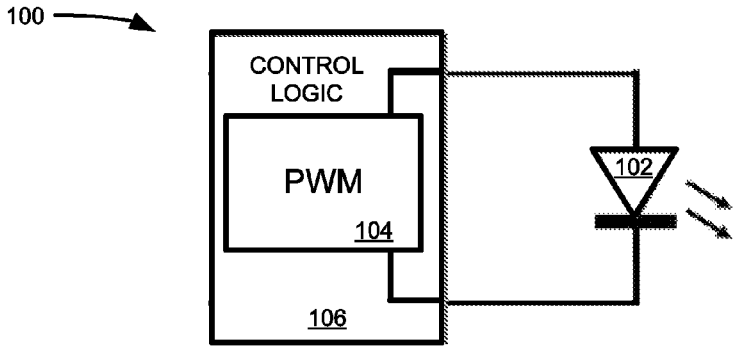
FIG. 1 is a schematic diagram of a light emitting diode operated by a pulse width modulated signal.

Referring to FIG. 1, there is illustrated a schematic diagram of a circuit 100 in accordance with an aspect of the present invention. Circuit 100 comprises a light emitting diode (LED) 102 coupled a pulse width modulation (PWM) circuit 104. Control logic 106 coupled to PWM circuit 104 controls the operation of PWM circuit 104.

PWM circuit 104 provides pulses to LED 102 to operate LED 102. Control logic 106 controls the width of the pulse sent by PWM circuit 104 to achieve a desired luminous intensity, while operating LED 102 at its characterized current. For example, referring to FIG. 3 with continued reference to FIG. 1, there is a signal diagram 300 illustrating three pulse width modulated signals 302, 304, 306 of differing widths. Pulse width signal 302 has a pulse width 312 that is the widest of pulse width modulated signals 302, 304, 306 and thus would achieve the highest luminous intensity from LED 102. Pulse width signal 306 has the lowest pulse width 316 of signals 302, 304, 306 and thus would achieve the lowest luminous intensity. Pulse width signal 304 has a pulse width 314 that is smaller than pulse width 312 of the high intensity signal 302, but larger than the pulse width 316 of the low intensity signal 306, thus pulse width signal 304 provides for a medium luminous intensity from LED 102. Although FIG. 3 illustrates three signals 302, 304, 306, this is merely for ease of illustration as any realistic number signals with different pulse widths can be employed to achieve any realistic number of varying intensities. The bridge rectifier added to the LED, 202, in FIG. 2 eliminates the need to respect polarity sensitivity.

A benefit of employing PWM is that PWM helps quench series circuit faults since the power goes to zero volts, reducing galvanic deterioration. Also, since current and voltage levels are lower, cable insulation will last longer. In addition, improved LED life can be achieved because the LED cools off in between pulses, resulting in a lower junction temperature (Tj).

Figure 3:
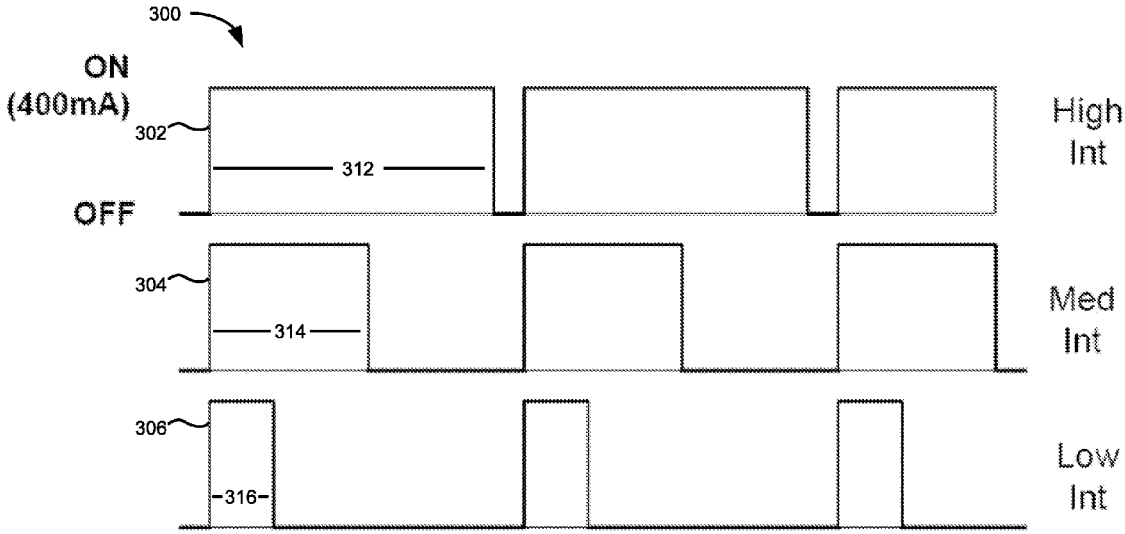
FIG. 3 is a signal diagram of DC pulse width modulated signals used for controlling the intensity of a light emitting diode.
Figure 4:
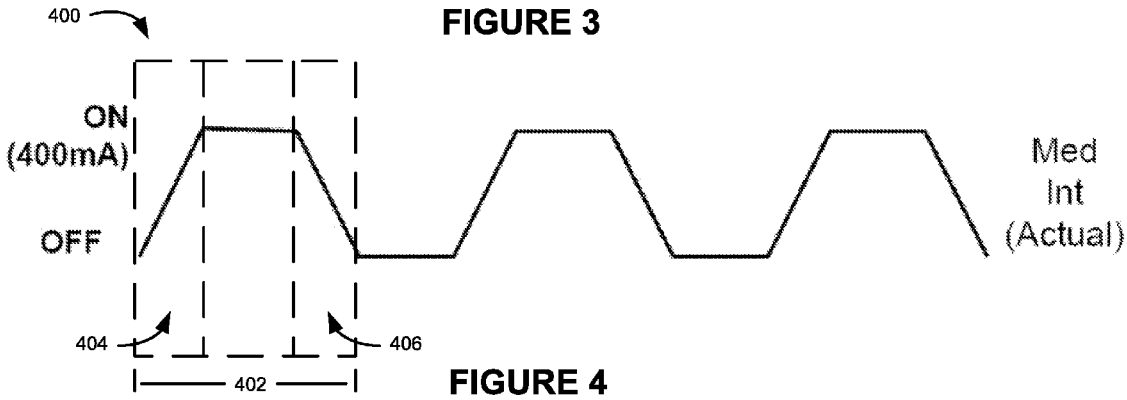
FIG. 4 is a signal diagram of DC pulse width modulated signals wherein the rise time and fall time of pulses is increased.

The rise time and fall time of the pulse width modulated signal may also be varied to reduce standing waves. FIG. 4 illustrates a signal 400 having pulses of pulse width 402. The length of the rise time 402 and fall time 404 can be increased (or the slope decreased) as illustrated by signal 400 in FIG. 4 when compared to signal 304 in FIG. 3. It should be appreciated that the rise time 402 and fall time 404 in FIG. 4 are illustrated in an exaggerated form, as in a preferred embodiment the rise time 404 and fall time 406 should range from 5-10% of pulse width 402.

A problem with narrow pulses is that standing waves can be produced. In accordance with an aspect of the present invention, LED 102 can be biased. Biasing LED 102 can be useful to reduce standing waves by reducing the magnitude of pulses applied to LED 102. For example, referring to FIG. 5, there are illustrated signals 502, 504, 506. Signal 502 has the widest pulse width and does not employ LED biasing (although LED biasing can be employed with signal 502 if desired). Signal 504, the medium intensity signal is biased at level 514. When pulses 524 are applied, the pulses only need to be of sufficient intensity to switch LED 102 into a conducting state. Similarly, signal 506 is biased at level 516. Because of signal 516, the magnitude of pulses 526 is the difference between the conducting (ON) state of LED 102 and bias 516. In a preferred embodiment, bias signals 514, 516 are approximately 90-95% of the conducting (ON) value.

Control logic 106 may suitably comprise a polarity reversing circuit. Reversing the polarity of the current can be useful to mitigate galvanic deterioration.

Figure 5:
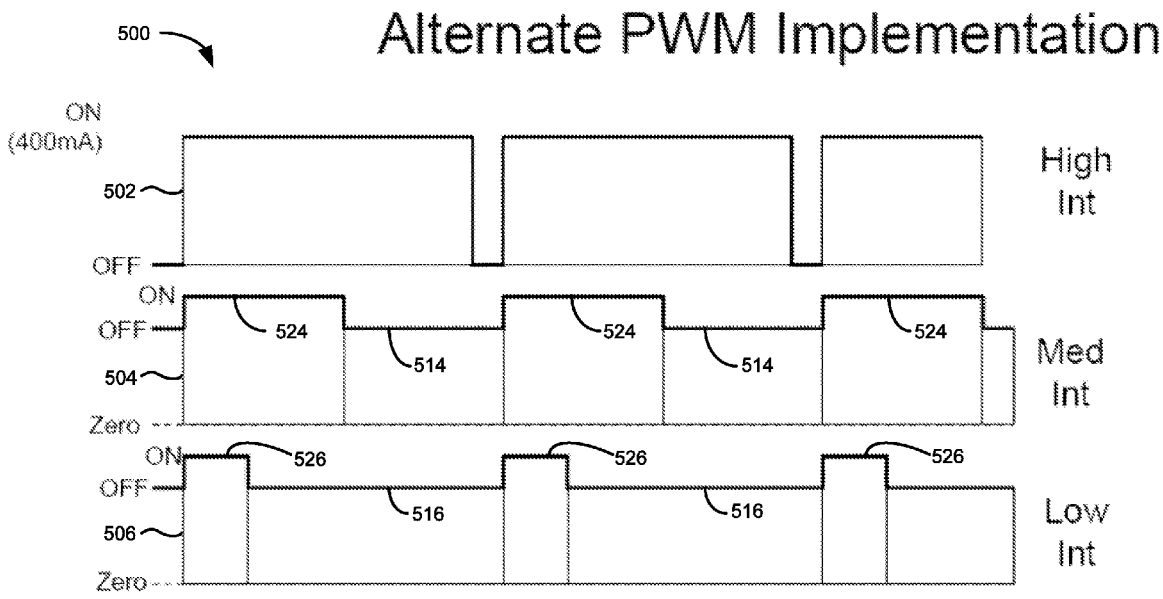
FIG. 5 is a signal diagram of a pulse width modulated signal with a bias signal.
Figure 6:
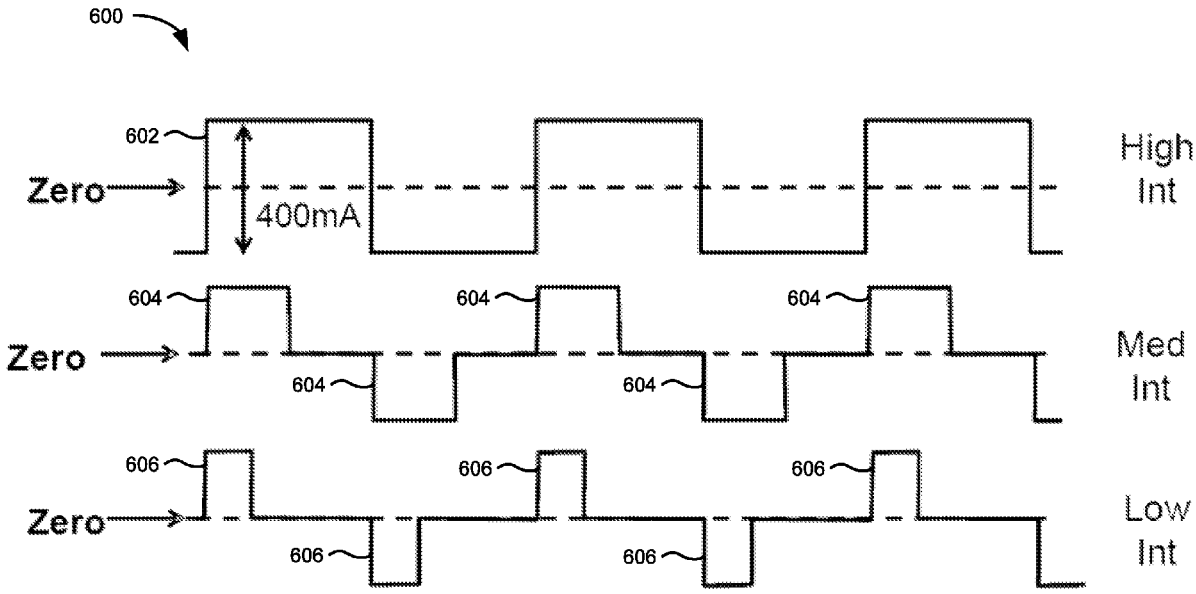
FIG. 6 is a signal diagram of AC pulse width modulated signals used for controlling the intensity of a light emitting diode.

It should be appreciated that signals 302, 304, 306, 404, 502, 504, 506 of FIGS. 3, 4 and 5 are DC PWM signals. Aspects of the present invention are also suitably adapted for use with AC PWM signals. By utilizing a rectifier circuit (e.g. a bridge rectifier), AC PWM signals 602, 604, 606 as illustrated in FIG. 6 can be employed for PWM operation of LED 102. As illustrated, signal 602 has the widest pulse width and would be employed for high intensity. Signal 606 has the lowest pulse widths and would be employed to achieve low intensity. Signal 604 has a pulse width larger than signal 506, but smaller than signal 602 and would be employed for medium intensity. As illustrated in signal 602, the difference between the positive peak 612 and negative peak 614 of the signal is the operating current (e.g. 400 mA as shown) for LED 102. Because AC PWM signals constantly change polarity, this helps quench series circuit faults and reduces galvanic deterioration.

Figure 7:
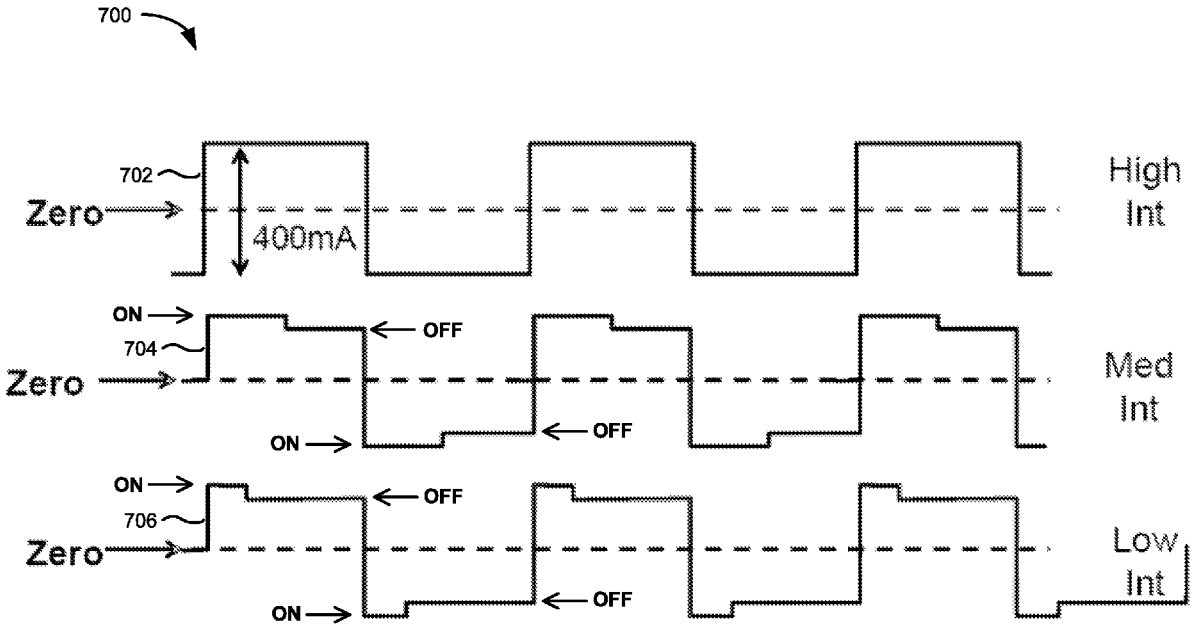
FIG. 7 is a signal diagram of AC pulse width modulated signals with a bias signal.

As was illustrated in FIG. 5 for DC PWM, AC PWM can also employ biasing to reduce the effects of narrow pulses as is illustrated in FIG. 7. FIG. 7 is a signal diagram 700 illustrating a PWM signal 702 for producing high intensity light, signal 704 for producing medium intensity light and signal 706 for producing low intensity light. Signal 704 is biased at level below the conducting threshold (OFF) of LED 102. Pulses of magnitude between a conducting level (ON) and below the conducting threshold (OFF) are employed to switch LED 102 on. The width of the pulses control the intensity of the light emitted from LED 102. Also, the slope of the rise time and/or fall time can be adjusted to reduce standing waves produces by the pulses.

Figure 2:
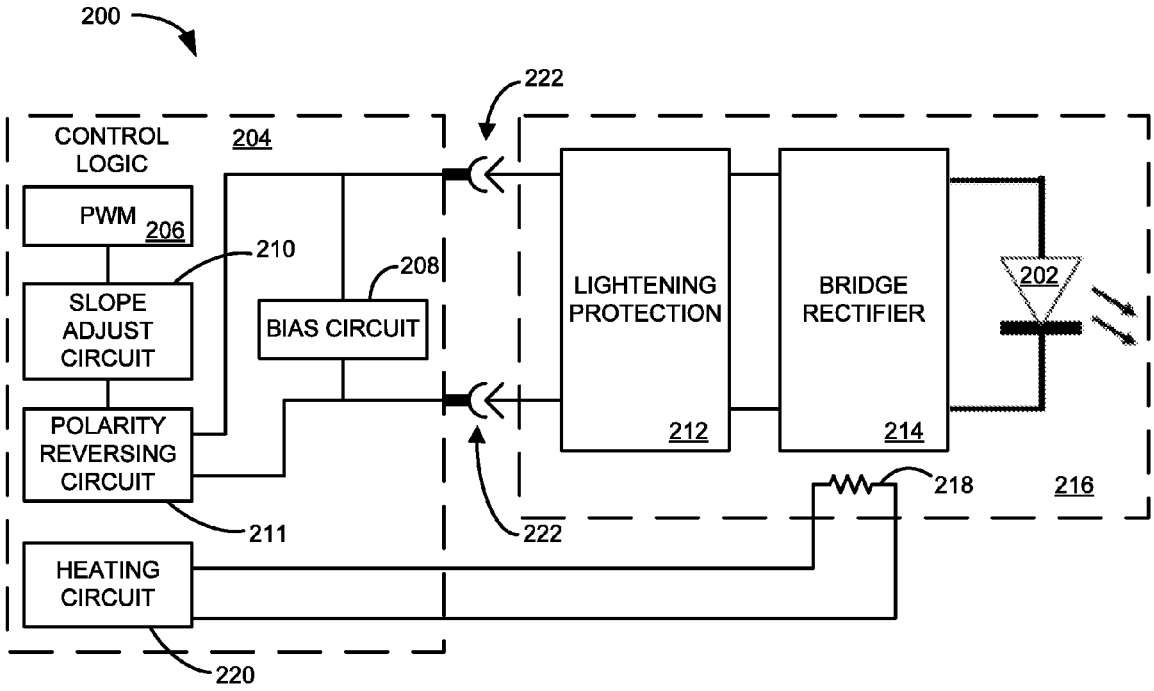
FIG. 2 is a schematic diagram of a light emitting diode operated by a pulse width modulated signal suitably adapted for airfield operation.

FIG. 2 is a schematic diagram 200 of a light emitting diode (LED) 202 operated by a regulator comprising control logic 204 for configured to send a pulse width modulated signal to achieve a desired luminous intensity suitably adapted for airfield operation. LED 202 is in a fixture comprising a housing 216 lightening protection 212 and bridge rectifier 214. The fixture is coupled to the regulator via plugs 222. The arrangement of components in FIG. 2 is for ease of illustration and should not be construed as being limited to the illustrated arrangement. Moreover, not all of the components illustrated are required for implementing aspects of the present invention.

Control logic 204 suitably comprises several circuits for controlling the operation of LED 202. A pulse width modulation circuit (PWM) 206 provides the pulses to LED 202. As already described herein (see e.g. FIGS. 3 and 6), PWM 206 varies the width of pulses provided to LED 202 in order to achieve a desired luminous intensity from LED 202. Bias circuit 208 provides a bias to LED 202 as illustrated in FIGS. 5 and 7. Slope adjust circuit 210 is employed to vary the slope of the rise time and/or fall time of pulse widths as illustrated in FIG. 4. A polarity reversing circuit 211 can be employed to reverse the polarity of current to mitigate galvanic deterioration.

As illustrated, LED 202 is inside housing 216. A heating element 218 is provided in housing 206 for cold weather operation. Heating circuit 220 controls the operation of heating element 218. Heating circuit 220 can employ a thermostat or other control mechanism for controlling the heating of housing 216 by heating element 218.

An aspect of circuit 200 illustrated in FIG. 2 is that only a minimal number of components are required inside housing 216. As illustrated housing 216 contains LED 202, lightening protection circuit 212, bridge rectifier 214 and heating element 218. For implementations that do not employ a polarity reversing circuit or AC PWM, bridge rectifier 214 can be eliminated. For warm climate implementations, heating element 218 can be eliminated. Thus, it is possible that housing 216 could only contain LED 202 and lightening protection circuit 212.

Figure 8:
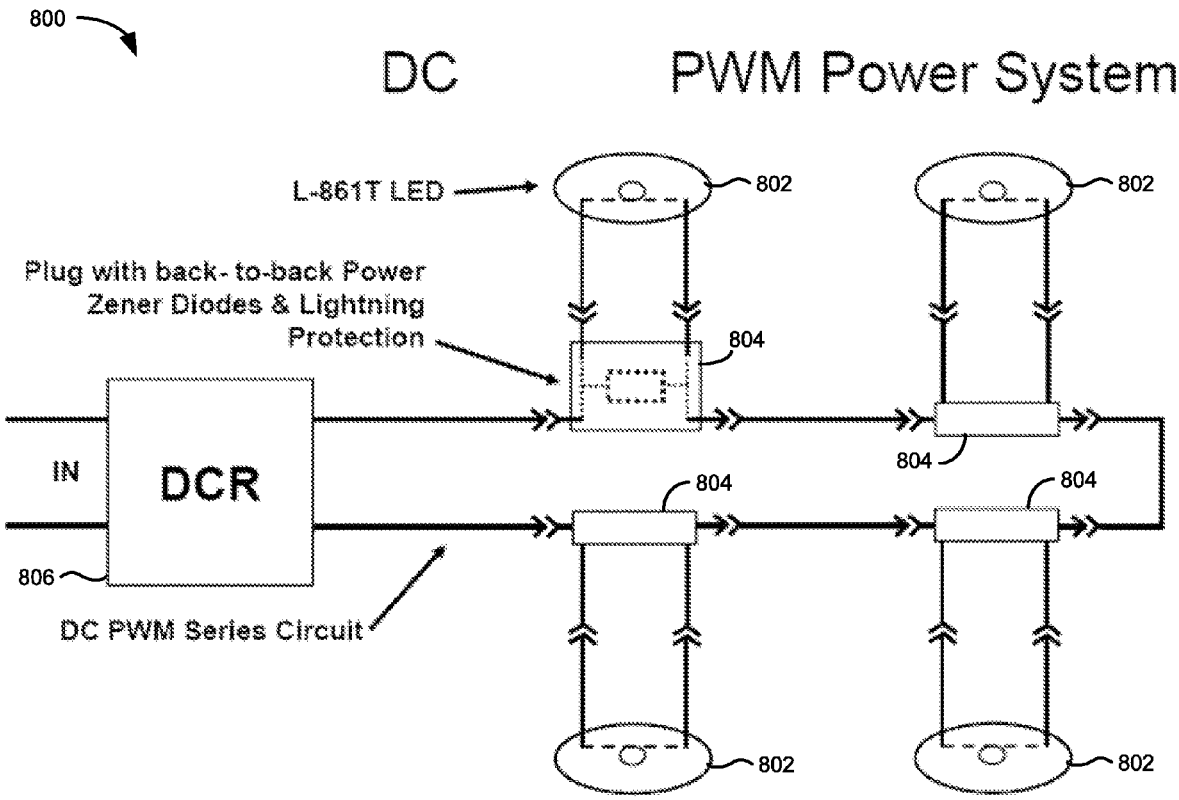
FIG. 8 is a schematic diagram of an airfield LED system employing a DC PWM power system.

Referring to FIG. 8, there is illustrated a DC PWM system 800 in accordance with an aspect of the present invention. DC PWM system 800 comprises LEDs 802 coupled by a plug with back-to-back Power Zener Diodes and Lightening Protection 804 to a series circuit that is coupled to Direct Current regulator (DCR) 806. DCR 806 provides DC PWM signals as described herein (see FIGS. 1 and 2) to operate LEDs 802. LEDs 802 are operated at their characterized current and pulse width of the PWM signal sent by DCR 806 is varied to achieve the desired luminous intensity from LEDs 802. As already described herein, DCR 806 can suitably comprise control logic for biasing LEDs 802, for adjusting the slope of the pulse widths of the PWM signal sent to LEDs 802, a and/or a polarity reversing circuit to produce PWM signals as described in FIGS. 3-5.

Figure 9:
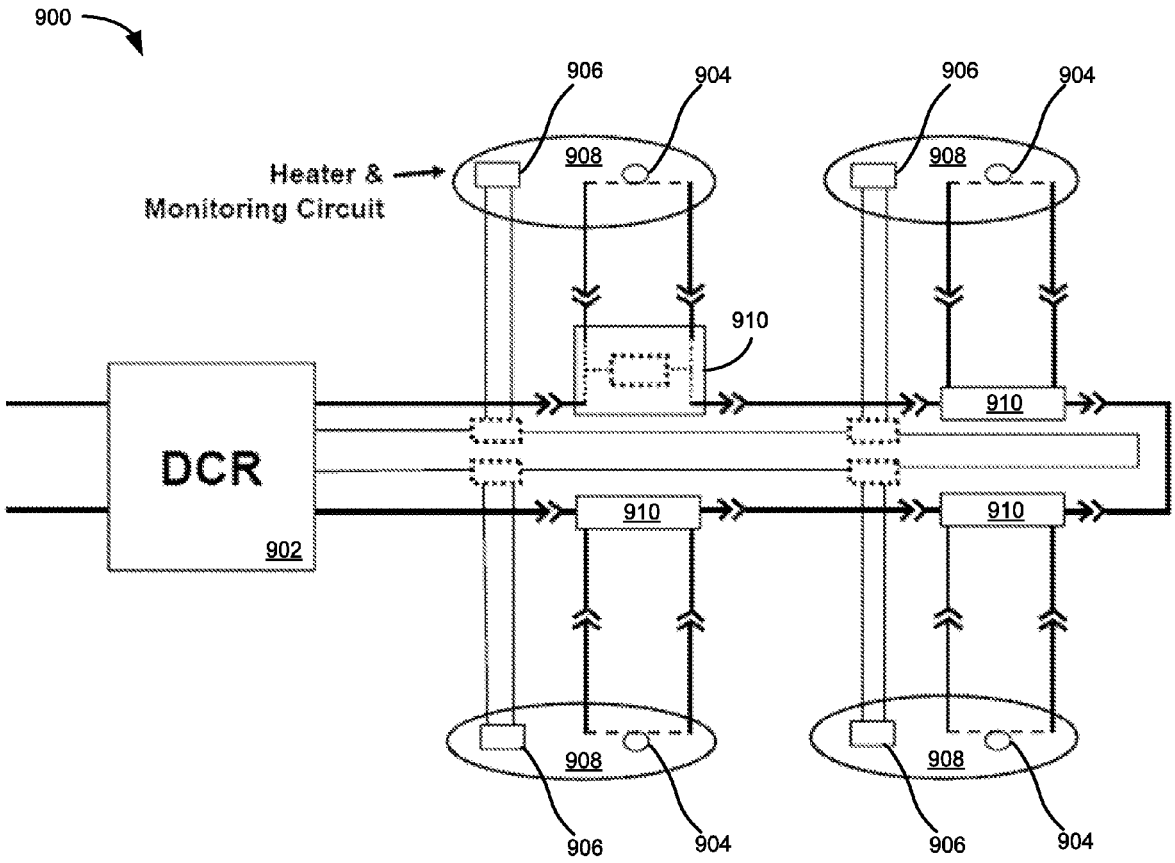
FIG. 9 is a schematic diagram of an airfield LED system employing a PWM power system and a heating system.

FIG. 9 is a schematic diagram of a DC PWM circuit 900 employing heating elements inside housings 908. A DC Regulator (DCR) provides pulses for operating LEDs 904 and also provides current for heating and monitoring circuits 906. Circuit 900 is a series circuit with plugs and back to back zener diodes 91 0, which provide power and protection to LEDs 904.

DCR 902 DC PWM signals as described herein to operate LEDs 904. LEDs 904 are operated at their characterized current and pulse width of the PWM signal sent by DCR 902 is varied to achieve the desired luminous intensity from LEDs 904. As already described herein (see FIGS. 1 and 2), DCR 902 can suitably comprise control logic for biasing LEDs 902, for adjusting the slope of the pulse widths of the PWM signal sent to LEDs 902, a and/or a polarity reversing circuit to provide PWM signals as described in FIGS. 3-5.

DCR 902 also provides power for operating heater elements 906. Heater elements 906 can be thermostatically controlled. A thermostat can be disposed with heating element 906 inside housing 908 or can be disposed at DCR 902.

Aspects of circuits 800, 900 in FIGS. 8 and 9 include that they provide a simple, economical approach for airfield lighting. Circuits 800, 900 are highly efficient. Circuits 800, 900 can employ less complex regulators 806, 902 than a 6.6 amp constant current regulator (CCR). Regulators 806, 902 can be configured to be interchangeable on different circuits. A 300 V regulator could handle 60 fixtures and a 600V regulator could handle 120 fixtures. Employing PWM can add some life to LEDs because the LEDs would be operating at a lower junction temperature (Tj). In FIG. 9, the heating and monitoring circuit can be implemented separately (and less complex). Furthermore, PWM helps quench series circuit faults since the power goes to zero volts (at any desired frequency). Since current and voltage levels are lower, insulation resistance will last longer.

Figure 10:
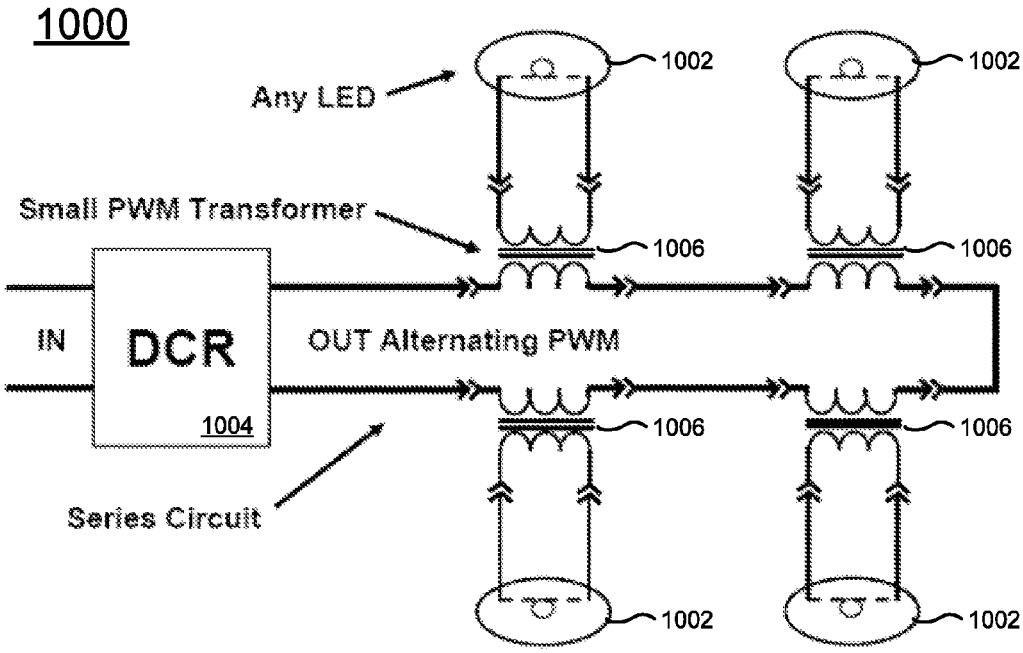
FIG. 10 is a schematic diagram of an airfield LED system employing a AC PWM power system.

FIG. 10 illustrates an alternating DC PWM circuit 1000. LEDs 1002 receive power from DCR 1004. The output of regulator 1004 is a PWM modulated alternating current. The turns ratio of transformers 1006 can be varied to match new loads.

As already described herein (see FIGS. 1 and 2), DCR 1002 can suitably comprise control logic for biasing LEDs 1002, for adjusting the slope of the pulse widths of the PWM signal sent to LEDs 1002, a and/or a polarity reversing circuit to provide PWM signals as described in FIGS. 4 and 6-7.

An aspect of an alternating DC PWM is that it can allow more fixtures per regulator 1002. Furthermore, transformers 1006 match the load of LEDs 1002 to regulator 1002. This allows the use of regulators that are universal and interchangeable as well as fixtures that are interchangeable with the appropriate transformer. Furthermore, lower gauge wire can be employed in circuit 1000. For example, a 4 amp regulator producing 2 KW would be operating at 500V, enabling 600V wiring to be employed.

Figure 11:
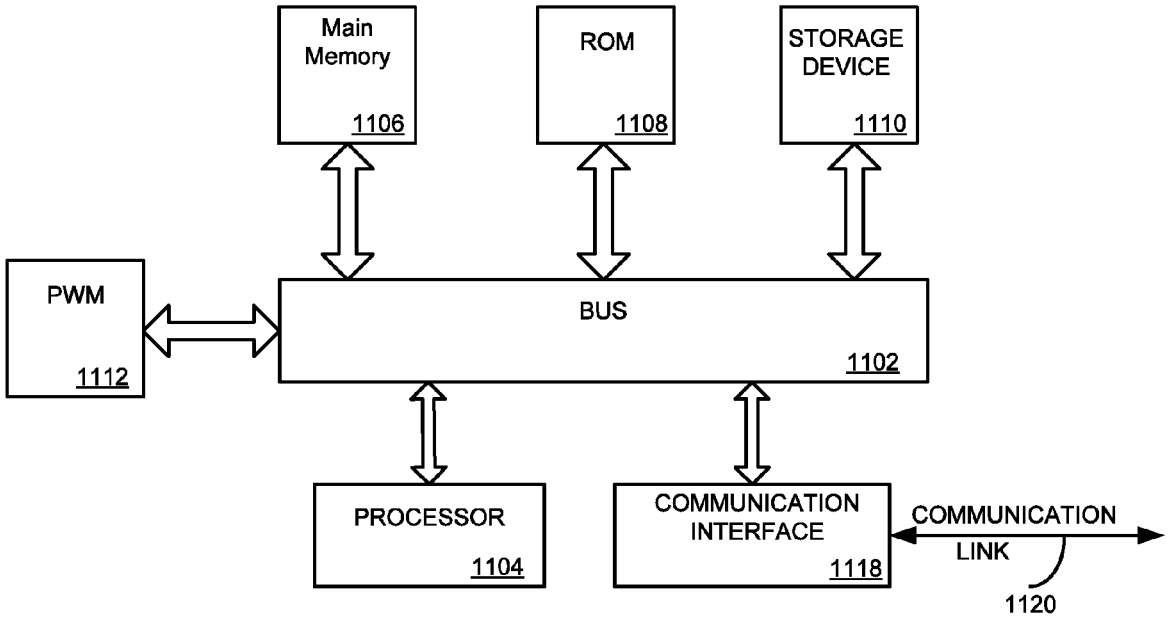
FIG. 11 is a block diagram of a computer system coupled to a pulse width modulation circuit upon which an aspect of the present invention is embodied.

FIG. 11 is a block diagram that illustrates a computer system 1100 upon which an embodiment of the invention may be implemented. Computer system 1100 includes a bus 1102 or other communication mechanism for communicating information and a processor 1104 coupled with bus 1102 for processing information. Computer system 1100 also includes a main memory 1106, such as random access memory (RAM) or other dynamic storage device coupled to bus 1102 for storing information and instructions to be executed by processor 1104. Main memory 1106 also may be used for storing a temporary variable or other intermediate information during execution of instructions to be executed by processor 1104. Computer system 1100 further includes a read only memory (ROM) 1108 or other static storage device coupled to bus 1102 for storing static information and instructions for processor 1104. A storage device 1110, such as a magnetic disk or optical disk, is provided and coupled to bus 1102 for storing information and instructions.

The invention is related to the use of computer system 1100 for controlling a LED using pulse width modulation. According to one embodiment of the invention, controlling a LED using pulse width modulation is provided by computer system 1100 in response to processor 1104 executing one or more sequences of one or more instructions contained in main memory 1106. Such instructions may be read into main memory 1106 from another computer-readable medium, such as storage device 1110. Execution of the sequence of instructions contained in main memory 1106 causes processor 1104 to perform the process steps described herein. One or more processors in a multi-processing arrangement may also be employed to execute the sequences of instructions contained in main memory 1106. In alternative embodiments, hard-wired circuitry may be used in place of or in combination with software instructions to implement the invention. Thus, embodiments of the invention are not limited to any specific combination of hardware circuitry and software. Processor 1104 sends signals to PWM 1112 via bus 1102 to control the operation of PWM 1112. PWM 1112 is responsive to the signals from processor 1104 to vary pulse width, biasing and/or shape of pulses produced by PWM 1112.

The term "computer-readable medium" as used herein refers to any medium that participates in providing instructions to processor 1104 for execution. Such a medium may take many forms, including but not limited to non-volatile media, volatile media, and transmission media. Non-volatile media include for example optical or magnetic disks, such as storage device 1110. Volatile media include dynamic memory such as main memory 1106. Transmission media include coaxial cables, copper wire and fiber optics, including the wires that comprise bus 1102. Transmission media can also take the form of acoustic or light waves such as those generated during radio frequency (RF) and infrared (IR) data communications. Common forms of computer-readable media include for example floppy disk, a flexible disk, hard disk, magnetic cards, paper tape, any other physical medium with patterns of holes, a RAM, a PROM, an EPROM, a FLASH-PROM, any other memory chip or cartridge, a carrier wave as described hereinafter, or any other medium from which a computer can read.

Various forms of computer-readable media may be involved in carrying one or more sequences of one or more instructions to processor 1104 for execution. For example, the instructions may initially be borne on a magnetic disk of a remote computer. The remote computer can load the instructions into its dynamic memory and send the instructions over a telephone line using a modem. A modem local to computer system 1100 can receive the data on the telephone line and use an infrared transmitter to convert the data to an infrared signal. An infrared detector coupled to bus 1102 can receive the data carried in the infrared signal and place the data on bus 1102. Bus 1102 carries the data to main memory 1106 from which processor 1104 retrieves and executes the instructions. The instructions received by main memory 1106 may optionally be stored on storage device 1110 either before or after execution by processor 1104.

Computer system 1100 also includes a communication interface 1118 coupled to bus 1102. Communication interface 1118 can provide a two-way data communication to an external or remote sight (not shown) using network link 1120. For example, an external device can be employed to control when the lighting system operates and the intensity. The external device can communicate and send commands to computer system 1100 via communication interface 1118. Communication interface 1118 can employ any suitable communication technique. For example, communication interface 1118 may be an integrated services digital network (ISDN) card or a modem to provide a data communication connection to a corresponding type of telephone line. As another example, communication interface 1118 may be a local area network (LAN) card to provide a data communication connection to a compatible LAN. Wireless links may also be implemented. In any such implementation, communication interface 1118 sends and receives electrical, electromagnetic, or optical signals that carry digital data streams representing various types of information. Computer system 1100 can send messages and receive data, including program codes, through the network(s), network link 1120, and communication interface 1118. The received code may be executed by processor 1104 as it is received, and/or stored in storage device 1110, or other non-volatile storage for later execution. In this manner, computer system 1100 may obtain application code in the form of a carrier wave.

Figure 12:
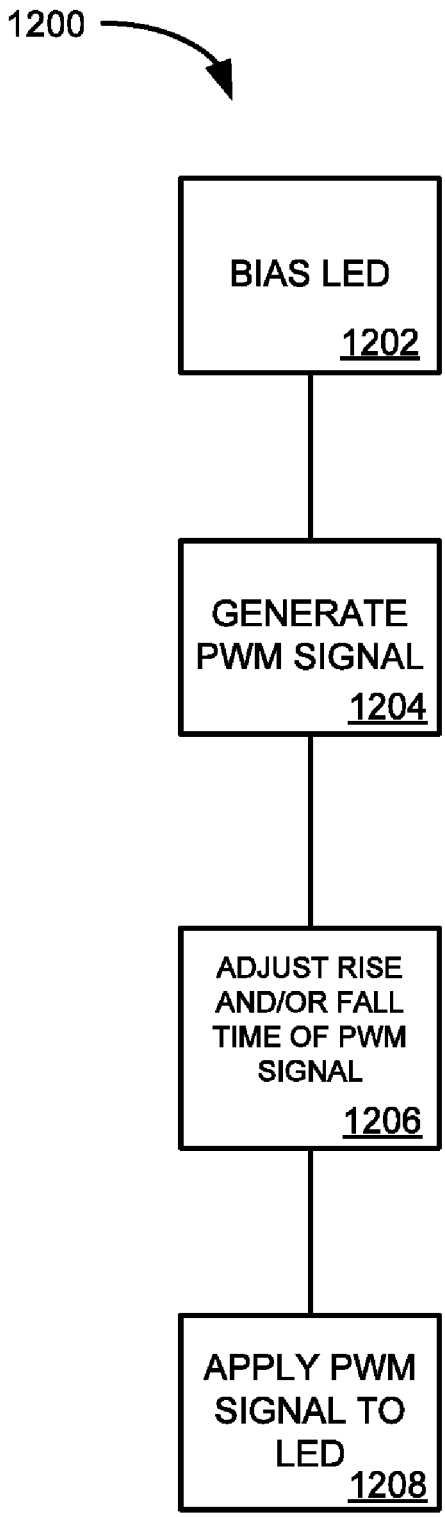
FIG. 12 is a block diagram of a methodology in accordance with an aspect of the present invention.

In view of the foregoing structural and functional features described above, a methodology in accordance with various aspects of the present invention will be better appreciated with reference to FIG. 12. While, for purposes of simplicity of explanation, the methodology of FIG. 12 is shown and described as executing serially, it is to be understood and appreciated that the present invention is not limited by the illustrated order, as some aspects could, in accordance with the present invention, occur in different orders and/or concurrently with other aspects from that shown and described herein. Moreover, not all illustrated features may be required to implement a methodology in accordance with an aspect the present invention. Embodiments of the present invention are suitably adapted to implement the methodology in hardware, software, or a combination thereof.

FIG. 12 is a block diagram of a methodology 1200 in accordance with an aspect of the present invention. Methodology 1200 is directed to a technique for operating a LED employing PWM. At 1202, a bias signal is applied to the LED. A bias signal can be employed at any level below the conducting threshold of the LED in order to reduce the magnitude of the pulse required to turn the LED on. See FIG. 5 for an exemplary signal diagram employing a bias signal.

At 1204, a PWM signal is generated for turning the diode on. In accordance with an aspect of the present invention, the duration of the pulse of the PWM is varied to achieve the desired luminous intensity from the LED. Longer pulse widths are used for higher intensity illumination and shorter pulse widths are used for dimmer intensities (see for example FIG. 3). This allows the LED to be operated at its characterized current, and because pulses reach zero volts mitigates degradation of field insulation resistance faults. Moreover, problems associated with uneven current distribution across an LED die (e.g. uneven illumination) are mitigated because the characterized current is employed, even for dimmed lighting.

At 1206, either one of the rise time or the fall time, or both, of the PWM signal is adjusted. Decreasing the slope (or conversely increasing the amount of time) of the rising and/or falling edges of the PWM signal can mitigate the impact of standing waves. The slope (or amount of time) of the rising and falling edges of the PWM signal can be selected to be proportional with the pulse width. For example, the rising and/or falling edges of the PWM signal can be set to about 5-10% of the pulse width (see for example FIG. 4).

At 1208, the PWM signal is applied to the LED. This causes the LED to conduct and emit light during the time period the pulse is at or above the conducting (ON) threshold of the LED.

What has been described above includes exemplary implementations of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims interpreted in accordance with the breadth to which they are fairly, legally and equitably entitled.

The invention claimed is:

1. An apparatus, comprising:

a light emitting diode; and control logic coupled to the light emitting diode;

a biasing circuit to bias the light emitting diode;

wherein the control logic is configured to operate the light emitting diode with a pulse width modulated signal having an associated pulse width, achieving a desired level of luminous intensity from the light emitting diode by adjusting the pulse width of the pulse width modulated signal;

wherein the light emitting diode has a plurality of bias signals such that the light emitting diode conducts when the plurality of bias signals are achieved; and wherein the biasing circuit is configured to bias the light emitting diode within 90 to 95% of the plurality of bias signals.

2. An apparatus according to claim 1, further comprising a rectifier coupled between the control logic and the light emitting diode.

3. An apparatus according to claim 2, further comprising a polarity reversal circuit coupled between the control logic and the rectifier.

4. An apparatus according to claim 1, wherein the pulse width modulated signal has an associated rise time, further comprising a slope adjustment circuit for adjusting the slope of the rise time such that the rise time is within a range of 2.5% and 5% of the pulse width.

5. An apparatus according to claim 4, wherein the pulse width modulated signal has an associated fall time, further comprising a slope adjustment circuit for adjusting the slope of the fall time such that the rise time is within a range of 2.5% and 5% of the pulse width.

6. An apparatus according to claim 1, further comprising a housing for retaining the light emitting diode; and a heating circuit operable to heat the housing coupled to the control logic, wherein the control logic is configured to operate the heating circuit separately from the light emitting diode.

7. An apparatus according to claim 1, further comprising:

means for housing the light emitting diode; and means for heating the housing.

8. An apparatus, comprising:

a light emitting diode;

means for biasing the light emitting diode; and means for operating the light emitting diode coupled to the light emitting diode;

wherein the means for operating the light emitting diode is configured to operate the light emitting diode with a pulse width modulated signal having an associated pulse width, achieving a desired level of light intensity from the light emitting diode by adjusting the pulse width of the pulse width modulated signal wherein the light emitting diode has a plurality of bias signals such that the light emitting diode conducts when the plurality of bias signals are achieved; and wherein the means for biasing is configured to bias the light emitting diode within 90 to 95% of the plurality of bias signals.

9. An apparatus according to claim 8, further comprising means for rectifying the pulse width modulated signal coupled between the means for operating the light emitting diode and the light emitting diode.

10. An apparatus according to claim 9, further comprising means for reversing polarity of the pulse width modulated signal coupled between the means for operating the light emitting diode and the means for rectifying.

11. An apparatus according to claim 8, further comprising a means for biasing the light emitting diode.

12. An apparatus according to claim 8, further comprising means for adjusting the rise time of the pulse width modulated signal, wherein the rise time is within a range of 2.5% and 5% of the pulse width.

13. An apparatus according to claim 12, further comprising means for adjusting the fall time of the pulse width modulated signal, wherein the fall time is within a range of 2.5% and 5% of the pulse width.

14. A method, comprising:

biasing a light emitting diode having a plurality of bias signals such that the light emitting diode conducts when the plurality of bias signals are achieved;

applying a pulse width modulated signal having an associated pulse width to the light emitting diode;

wherein the pulse width is adjusted to achieve a desired luminous intensity from the light emitting diode; and wherein the light emitting diode is biased with 90% to 95% of the plurality of bias signals.

15. A method according to claim 14, wherein the magnitude of the pulse with modulated signal is constant.

16. A method according to claim 14, further comprising adjusting the slope of the rise time of the pulse width modulated signal.

17. A method according to claim 14, further comprising adjusting the slope of the fall imte of the pulse width modulated signal.

* * * * *